United States Patent [19]

Hernandez et al.

[11] 4,049,005

[45] Sept. 20, 1977

[54] FILTERING APPARATUS FOR CIGARETTE SMOKERS

[76] Inventors: Armando C. Hernandez, 1582 Clear View Lane, Santa Ana, Calif. 92705; Jack P. Prohoroff, 9736 Pettswood Drive, Huntington Beach, Calif. 92646

[21] Appl. No.: 687,308

[22] Filed: May 17, 1976

[51] Int. Cl.[2] ..... A24F 13/02

[52] U.S. Cl. ..... 131/187; 131/198 A

[58] Field of Search ..... 131/187, 198 A, 198, 131/210

[56] References Cited

U.S. PATENT DOCUMENTS

| | | | |
|---|---|---|---|
| 3,058,476 | 10/1962 | Atkins | 131/187 |
| 3,312,227 | 4/1967 | Barnett | 131/187 |
| 3,313,308 | 4/1967 | Grasso | 131/187 |
| 3,636,960 | 1/1972 | Blount et al. | 131/187 |
| 3,926,199 | 12/1975 | Thomas | 131/187 |

*Primary Examiner*—Stephen C. Pellegrino
*Attorney, Agent, or Firm*—Grover A. Frater

[57] ABSTRACT

Improved performance in a cigarette filter of the kind that is housed in a cigarette holder is accomplished by incorporating a restriction in the flow path through the holder in which smoke is accelerated. That is followed by an expansion chamber into which ambient air is drawn to accomplish cooling and condensation of tars and nicotine products and to produce a turbulence. As a consequence, the condensate is made to impinge upon the surface of the filter element where it is retained.

5 Claims, 5 Drawing Figures

FILTERING APPARATUS FOR CIGARETTE SMOKERS

This invention relates to improvements in cigarette filters and in apparatus for aiding tobacco smokers to withdraw from the tobacco habit. One class of apparatus of that kind is housed in a cigarette holder and is formed with an opening by which ambient air is introduced into the smoke stream to aid in condensing tars and nicotine products from the smoke in the holder. This invention relates to improvements in apparatus of that class.

BACKGROUND OF THE INVENTION

It is well established that most of the tar and nicotine products can be removed from cigarette smoke by the use of a cigarette holder arranged so that those materials are condensed out of the smoke before it reaches the outlet opening of the holder and the smoker. It is possible to remove almost any selected percentage of those materials. Thus, to the extent that cigarette smoking can be made more safe, or less likely to be injurious to the smoker's health, the creators of tar and nicotine filtering apparatus can achieve almost any degree of safety of freedom from injury. However, to create such an apparatus which smoker's will attempt to use and will continue to use has proven to be a much more difficult task.

The acceptance of cigarette smoke filtering devices appears to be the function of three variables. The first is the degree of inhalation suction required to use the device. Another variable is the taste of the smoke, or the "strength" or "weakness" of the smoke. The last is the smoker's motive in using the filtering device. Acceptance of cigarette smoke filtering apparatus diminishes as the degree of inhalation suction increases significantly beyond what is required for normal cigarette smoking. Further, the use of cigarette smoke filtering apparatus diminishes if the smoke that reaches the smoker tastes significantly different from the taste of unfiltered cigarette smoke. Taste appears to be a function both of the composition of the smoke and of its temperature. If the smoker's motive is to remove part of the nicotine and tar content of the smoke so that he can continue the smoking habit with less likelihood of injury to himself, he may be willing to put up with a change in inhalation suction requirement and taste sufficiently long so that he becomes accustomed to the changed condition. On the other hand, the smoker whose objective is to rid himself of the smoking habit, and who believes that he must have a means for withdrawing by degrees, is likely to be less tolerant of changes in taste and suction requirements. It is easy to condense out the tars and nicotines produced by reducing the temperature of the smoke, but temperature reduction translates into a change in taste. While less easy, it is possible to remove tars and nicotine by utilizing the fact that the tar and nicotine products have greater mass than does the smoke and can be removed by increasing their kinetic energy to the point where they cannot change direction with the same facility as can the lighter smoke. However, increasing kinetic energy of the solid and semi-solids of the smoke requires that they be accelerated at the cost of increase in inhalation suction.

A number of prior art filters and smoker's withdrawal kits have sought to combine these two approaches in an effort to find an acceptable compromise between degradation of taste and increase in inhalation suction requirement. Finding an appropriate compromise is not merely a matter of balancing those two variables. Since normal suction pressure, the suction pressure that is required in the absence of any filtering apparatus, varies greatly during each "puff" or inhalation event, the amount of inhalation suction that is required during an inhalation event can be modified by the provision of smoke storage areas in the flow path through the filtering apparatus and its supporting structure.

An examination of the prior patents in this field will disclose that there are a variety of structures that can be used to cool and accelerate and decelerate and store smoke. Unfortunately, the thermal and aero-dynamic and hydraulic problems are sufficiently complex so that creating new filtering systems requires far more than creating new combinations of old features. Effective filters exist, but there is a need for new structures. That need arises out of the need to make them more useful in terms of the ease with which they can be kept clean, the cost of their production, and the security they provide against any trapped solids or liquids reaching the smoker's end of the device.

SUMMARY OF THE INVENTION

It is the purpose of the invention to provide an improved apparatus for removing tars and nicotine products from tobacco smoke. It is an object to do that in an improved cigarette holder, it being understood that that term "cigarette holder" applies both to a holder for smoking conventional cigarettes and cigars.

It is a particular object to provide a cigarette holder which utilizes both condensation and momentum to accomplish removal of unwanted components of the smoke, and which does that in a way that provides a minimu alteration of the suction pressure and the taste that a smoker experiences in the absence of a filtering structure. It is a further object to provide such a structure which can be cleaned with ease and which operates such that most of the filtrate is deposited on a portion of the structure that us readily accessible for cleaning. It may be cleaned instead of being thrown away. That feature, combined with the fact that cooling is accomplished by the addition of ambient air, makes the structural arrangement suitable both as a filter unit for one who wants to continue smoking and as an element of a smoker's withdrawal kit.

For whatever reason, withdrawal kits are more successful in aiding people to withdraw from the smoking habit if the kit contains a number of separate cigarette holders each effective to remove different degree of unwanted material. That is accomplished by changing no more than the area of an ambient air inlet opening. One holder of a set is all that is required by one who intends to continue smoking but wants to eliminate some selected portion of the cigarette smoke's tar and nicotine. The invention provides such a user with an apparatus that will accomplish that purpose and which can be cleaned with relative ease if he desires. To provide an apparatus which can serve that dual purpose, so that a single structure can be marketed as product having different functions, is another object of the invention.

There are other advantages of the invention which will hereinafter appear. One major advantage, however, is that the invention provides a structure whose result is to provide what appears to the smoker to be a lesser change from normal taste and inhalation suction than what has been true of prior apparatus for a given degree of tar and nicotine removal.

These objects and advantages of the invention are realized by the inclusion of an ambient air inlet opening at a point downstream from the point at which the smoke is accelerated to increase the momentum of its intrained solid and liquid materials. The smoke is accelerated and then is introduced into an expansion chamber where ambient air is aspirated in not only to cool and condense tar and nicotine products, but also to cause a flow turbulence of the kind that will insure that the condensed products collide with one another and with the surface of the filter element. The condensed materials adhere to the latter and are effectively removed from the smoke.

The use of an ambient air inlet opening downstream from the acceleration point provides an effective cooling flow so that it is not essential that the structure include a second ambient air inlet opening upstream from the acceleration point. Nonetheless, the use of two air inlet openings is preferred. The upstream opening serves to precool the smoke and to condense out some tar and nicotine products prior to acceleration. That having been done, the velocity of the condensate materials, on leaving the acceleration region and upon entering the turbulent expansion area, will be less than would be true if they had passed through that region in gaseous form. Consequently, there is less likelihood that those condensed materials will escape being deposited on the filter. Ambient air at both inlets serves to cool and condense solids and liquids.

Summarizing, the air entering at the downstream point serves also to introduce a violent turbulence in the flow which aids in the mechanical task of separating out the now condensed unwanted materials.

The use of an ambient air inlet opening downstream from the acceleration point has another advantage. Because acceleration is required to get the filtration job done without excessive cooling, and because acceleration must occur prior to filtration, the structure in which acceleration of the smoke is accomplished must necessarily be toward the forward end of the cigarette holder. The precooling ambient air inlet must necessarily be upstream from that. The task of precooling is accomplished most effectively if the precooling ambient air is introduced into a smoke storage chamber downstream from the end of the cigarette that extends into the coupler, and upstream from the restricted passage in which acceleration is accomplished. The cigarette is held in the holder by the coupler. Recent years have seen a change in the variety of cigarette diameters, both between brands and between cigarettes of a given brand. Moreover, the introduction of the "thin" cigarette has given rise to the need to accommodate two different standard sizes, both of which are subject to a substantial amount of variation. As a consequence, it is not feasible to provide a coupler which incorporates a stop to limit the degree of insertion of the cigarette and thereby to insure that the volume of the storage chamber will remain the same each time that a cigarette is inserted into the holder. If a cigarette holder is to be able to accommodate all of the popular sizes and brands of cigarettes, the coupler must serve as an adapter no longer able to insure that the storage space has a given volume. As a consequence, those cigarette holder structures that involve only an ambient air inlet opening upstream from the accelerator differ widely in their filtering result from one cigarette size to another and even from one brand to another. That variability is overcome, in part, in the invention by introduction of ambient air at a downstream point and by the use of a novel coupler which, by its construction, insures that the upstream storage space will have a volume as close to the maximum design volume as is possible for any given cigarette diameter.

DESCRIPTION OF THE PREFERRED EMBODIMENT

Figure 1:
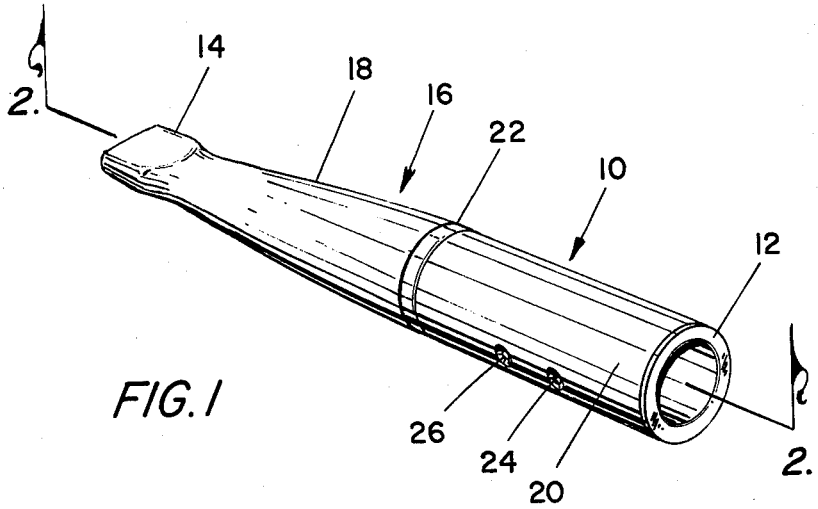
FIG. 1 is a perspective view of a cigarette holder which embodies the invention.

The cigarette holder 10 shown in FIG. 1 embodies the invention. At its upstream, cigarette end, it comprises a coupler 12. An end of the cigarette, or cigar, is inserted in that end of the device. The other end, the outlet end, terminates in a bit 14. The portion intermediate the ends is called the shank 16. The rearward, tapered part of the shank 18 is usually called the mouthpiece. It is formed integrally with the bit and, in the illustrated embodiment, it is formed integrally with the filter which is a structure at the forward end of the mouthpiece and is housed within the barrel 20. The band of material 22 which appears between the mouthpiece 18 and the barrel 20 is a decorative trim piece.

There are two air inlet openings, 24 and 26. Both are visible at the side of the barrel in FIG. 1. The barrel can be rotated relative to the mouthpiece 18 and the ring 22 about the central axis of the unit, and the position of those air openings will depend upon the rotational orientation of the barrel. The holder is made to be taken apart so that the barrel with the coupler can be removed from the mouthpiece 18 to expose the filter element, and the user can be expected to remove and replace the barrel many times. The air inlet openings are shown at the side in FIG. 1 so that they lie in the same plane as do a pair of laterally extending passageways that are formed in the mouthpiece and are not visible in FIG. 1. Arranging the structure in that way simplifies the task of depicting the invention in FIG. 2 and of explaining its operation.

Figure 2:
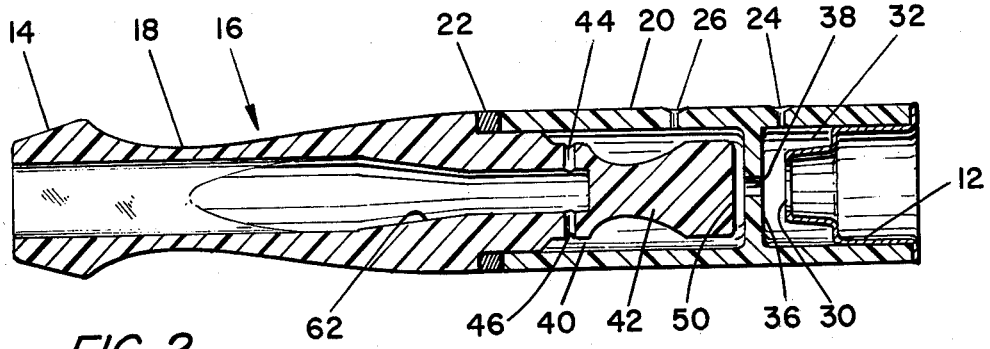
FIG. 2 is a cross-sectional view of the cigarette holder taken on line 2—2 of FIG. 1.

The bit 14 is wider than it is high so that it will be oriented as shown in FIG. 1 when it is in use. On that basis, FIG. 2 is a cross-sectional view taken on the horizontal mid-plane through the holder. The shank forms the housing for a flow path for smoke that enters at the coupler 12 and proceeds through the downstream exit opening 30 of the coupler into a storage chamber 32 that is formed by the rearward side of the coupler 12 and the forward side of a transverse barrier wall 36 and is bounded by the inner wall of the barrel forwardly of the barrier wall 36. Except for the barrier wall 36, the barrel is a cylindrical sleeve formed with a cylindrical inner wall. Wall 36 is formed with a through opening, or perforation, 38 at its center. That opening is sufficiently small so that smoke is accelerated as it is drawn through the perforation past the barrier 36.

On passing through the perforation 38 the smoke enters the rear chamber 40 of the barrel. That chamber houses a plug or filter element 42 which, except for laterally extending exit openings 44 and 46, is symmetrical about its central axis which axis is coincident with the axis of the perforation 38 and the axis of the holder. The filter is generally cylindrical except that it has reduced diameter in the mid-region of its length. At its forward or upstream end the filter terminates in what in this embodiment is a flat fact 50 spaced downstream from the barrier 36. In the embodiment shown, the perforation 38 has a diameter of approximately 0.05 inches. The separation between the downstream face of barrier 36 and the upstream face 50 of the filter is between 15 and 20 thousandths of an inch. The filter has a diameter smaller, at its forward end, than the inner diameter of the barrel 20 so that the outer wall of a filter element is spaced 15 to 20 thousandths of an inch from the inner wall of the barrel. The forward portion of the filter 42 is substantially cylindrical for a distance of about 75 thousandths of an inch. That region is identified by the reference numeral 52. The rearward section 54 of the filter is also cylindrical and advantageously has a diameter less than that of the section 52. A reduction in diameter of 25 thousandths of an inch is appropriate and describes the embodiment illustrated in the drawings.

That portion of the filter which lies between the forward section 52 and the rearward section 54 is identified by the reference numeral 56 and it has reduced diameter. It is in this section of the filter in which tar and nicotine products are to be deposited along with any moisture that is condensed out of the smoke. The filter has reduced diameter at that section to form a cavity in which flow of smoke is made very turbulent. That is accomplished in the invention by reducing the diameter of the filter whereby an annular cavity is formed. Smoke is admitted into that cavity around the entire periphery of the forward section 52. Flow can proceed from the cavity only through spaced exit openings. That along results in some turbulence. However, turbulence is induced primarily by the bringing of ambient air into the chamber at one point as distinguished from smoke flow which can proceed uniformly around the entire forward section 52 of the filter element. At this point, it should be made clear that ambient air can be brought in at more than one point. However, the use of a single inlet opening is preferred. The quantity of ambient air that is introduced into the stream must be limited so that it does not cool the smoke excessively and alter the taste needlessly. It is easier to control the size of a single small opening than it is to control the size of a number of very small air inlet openings.

Experience indicates that the surface shape of the reduced diameter section 56 is not critical, although the shape that it is shown to have in the drawings is the best shape that Applicants have discovered. It is described as having a shape inverse to that of a tear drop in cross-section with the larger end of the tear drop oriented in the downstream direction. That shape is considered to be best because it is easy to clean, but even more because it results in deposition of a majority of the filtrate in the cutout portion rather than on the interior wall of the barrel which is much more difficult to clean than is the filter element.

The ambient air inlet opening 26 in this embodiment extends through the wall of the barrel at the downstream end of filter 6 and 52 and the forward end of filter 6 and 56. That appears to be the best position in that it results in minimum deposition of filtrate on the barrel wall. However, it can be positioned upstream opposite the surface of section 52 without an appreciable change in the quantity of filtrate that is removed from the smoke.

The quantity of unwanted material that is removed is a function primarily of the combined area of ambient air inlet openings 24 and 26. It is now preferred that the opening 26 have a diameter of about 25 thousandths of an inch. If the unit is to be reproduced in withdrawal kit form, it is now preferred that the diameter of the air inlet opening 24 be about 28 thousandths of an inch in a unit that is intended to remove 85 percent or more of the smoke and tar products; that the diameter of that opening be about 24 thousandths of an inch when it is desired to remove about 65 percent of the smoke and tar products; that the diameter be about 20 thousandths of an inch for the removal of 40 to 50 percent of the tar and nicotine products; and that there be no opening 24 when it is desired to remove only about 25 percent of the tar and nicotine products. A smoker's withdrawal kit incorporating holders having inlet openings 24 in those sizes would ordinarily include a suggested withdrawal program in which the smoker was encouraged to use the holder with no opening 24 for a period of 10 days to 2 weeks. Thereafter, for a like period, use of the holder with the 20 thousandths diameter hole would be recommended. At the end of that period, and for a like period, it would be recommended that the user do his smoking with the holder that has the 24 thousandths of an inch diameter hole. The instruction would suggest that the user then turn to the last of the holders, the one with the opening 24 having about 28 thousandths of an inch diameter, and that he smoke that for a short period before attempting to get along without any smoking.

Not all users of withdrawal kits are able to stop smoking entirely. Many progress through the withdrawal procedure to one of the holders and then abandon the withdrawal attempt by continuing to smoke using that holder. One of the objects of the invention is to provide a structure in which the user can do just that and have an apparatus that will continue to be effective and useful for a protracted period, primarily because of the ease with which it can be cleaned and the uniformity of its performance.

Downstream of the filter, at section 60, the mouthpiece 18 has increased diameter so that the section 60 has a sliding fit within the downstream end of the barrel 20. The user simply grasps the mouthpiece between two fingers of one hand and the barrel between two fingers of the other hand and pulls to separate the barrel from the mouthpiece whereby to expose the filter element 42. Openings 44 and 46 are sufficiently small in diameter so that the smoke is accelerated greatly as it passes through those openings. As a consequence, no tar and no nicotine is deposited in those passageways. The smoke is permitted to expand in the passageway 62 which completes the flow path from the transverse openings 44 and 46 to the downstream opening at the bit 14. That passageway is made relatively large and the surfaces are made smooth to prevent the deposition of filtrate material on those surfaces. Occassional cleaning with a pipe cleaner may be desirable and the smooth interior surface facilitates that activity.

The coupler 12 is specially made. It is symmetrical about its central axis which axis is coincident with that of the cigarette holder when the coupler is assembled in the unit. At its upstream end, the coupler has an outwardly extending flange 70 which bears against the forward surface of the barrel 20 and serves to limit the degree of its insertion into the cavity 32 upstream from barrier 36. The upstream section 72 of the coupler has larger diameter than does the downstream section 74. The upstream section 72 has a size to accommodate cigarettes of "regular" diameter. Section 74 has diameter to accept "slim" cigarettes. The inner wall of the section 72 is substantially cylindrical. The variation in the size of cigarettes appears primarily as a variation of circumference. That results in relatively small change in diameter of regular cigarettes so that it is possible to employ a cylindrical coupling element for those cigarettes. The variation in circumference of the slim cigarettes is of the same order, but that results in proportionally greater variation in diameter in the slim cigarettes. To insure a proper accommodation of the slim variety, the lower section 74 of the coupler is tapered in a very slight amount so that the inner diameter of section 74 is less as one approaches the downstream end of the coupler 12. The degree of insertion of the regular sized cigarette is limited by the shoulder 76 which is formed at the junction of sections 72 and 74. The degree of insertion of the slim cigarette is limited by a short inwardly extending flange 78 at the downstream end of the coupler.

Figure 4:
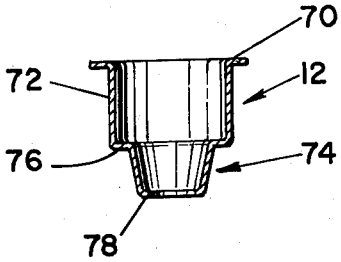
FIG. 4 is an enlarged view in central section of the coupler portion of the holder.
Figure 5:
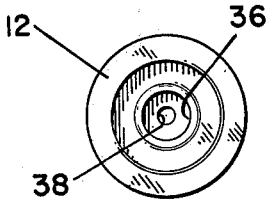
FIG. 5 is a view looking along the axis of the holder from its coupler end.
Figure 3:
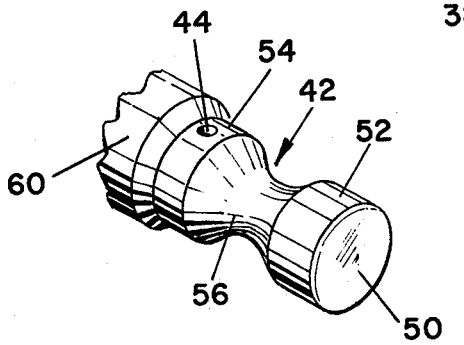
FIG. 3 is an isometric view of the filter element.

The taper in FIG. 4, and in FIG. 2, is exaggerated beyond what is required and what is actually employed. The taper has been exaggerated in the drawing for the sake of clarity. The following dimensions are typical in practice. The section 74 is 0.2 of an inch long. It has a diameter of 0.269 inches at its upstream end and it has a diameter of 0.255 inches at its downstream end. Those numbers are representative numbers rather than absolute requirements, but they do represent what is intended to be depicted in the drawings.

Although we have shown and described certain specific embodiments of our invention, we are fully aware that many modifications thereof are possible. Our invention, therefore, is not to be restricted except insofar as is necessitated by the prior art.

We claim:

1. In a cigarette holder of the kind in which tars and nicotine components are to be precipitated out of the smoke and which holder includes a shank having a cigarette coupler at its smoke input end and a bit at its smoke outlet end and a flow path extending through the shank from the inlet at the coupler to the outlet at the bit, in combination:

means in said flow path for causing smoke traversing the flow path to be accelerated, change direction, and expand, in that order, at first, second and third successive positions, respectively, along said flow path;

means for introducing a quantity of ambient air into said flow path at said third position at which said smoke is made to expand; and a second inlet for ambient air formed through the wall of said shank downstream from said coupler and upstream from said first of said positions.

2. In a cigarette holder of the kind in which tars and nicotine components are to be precipitated out of the smoke and which holder includes a shank having a cigarette coupler at its smoke input end and a bit at its smoke outlet end and a flow path extending through the shank from the inlet at the coupler to the outlet at the bit, in combination:

means in said flow path for causing smoke traversing the flow path to be accelerated, change direction, and expand, in that order, at first, second and third successive positions, respectively, along said flow path;

means for introducing a quantity of ambient air into said flow path at said third position at which said smoke is made to expand;

means for causing smoke to be accelerated comprising a barrier extending across said flow path downstream from said coupler and formed with a perforation to complete said path; and a second inlet for ambient air formed through the wall of said shank downstream from said coupler and upstream from said barrier.

3. In a cigarette holder of the kind in which tars and nicotine components are to be precipitated out of the smoke and which holder includes a shank having a cigarette coupler at its smoke input end and a bit at its smoke outlet end and a flow path extending through the shank from the inlet at the coupler to the outlet at the bit, in combination:

means in said flow path for causing smoke traversing the flow path to be accelerated, change direction, and expand, in that order, at first, second and third successive positions, respectively, along said flow path;

means for introducing a quantity of ambient air into said flow path at said third position at which said smoke is made to expand;

means for causing smoke to be accelerated comprising a barrier extending across said flow path downstream from said coupler and formed with a perforation to complete said path;

said shank being formed with a substantially cylindrical chamber immediately downstream from said barrier with its axis substantially coincident with that of the shank;

said means for causing smoke to change direction comprising a filter plug disposed in said chamber with its axis substantially coincident with the axis of said chamber and with its upstream end in close proximity to said perforation in said barrier, the diameter of the forward end of said plug being greater than the diameter across said perforation and less than the diameter of the shank at said chamber; and a second inlet for ambient air formed through the wall of said shank downstream from said coupler and upstream from said barrier.

4. In a cigarette holder of the kind in which tars and nicotine components are to be precipitated out of the smoke and which holder includes a shank having a cigarette coupler at its smoke input end and a bit at its smoke outlet end and a flow path extending through the shank from the inlet at the coupler to the outlet at the bit, in combination:

means in said flow path for causing smoke traversing the flow path to be accelerated, change direction, and expand, in that order, at first, second and third successive positions, respectively, along said flow path;

means for introducing a quantity of ambient air into said flow path at said third position at which said smoke is made to expand;

means for causing smoke to be accelerated comprising a barrier extending across said flow path downstream from said coupler and formed with a perforation to complete said path;

said shank being formed with a substantially cylindrical chamber immediately downstream from said barrier with its axis substantially coincident with that of the shank;

said means for causing smoke to change direction comprising a filter plug disposed in said chamber with its axis substantially coincident with the axis of said chamber and with its upstream end in close proximity to said perforation in said barrier, the diameter of the forward end of said plug being greater than the diameter across said perforation and less than the diameter of the shank at said chamber;

said means for causing smoke traversing the flow path to be expanded comprising an enlargement of said chamber formed by a reduction in the diameter of said plug at a region downstream from its upstream end; and a second inlet for ambient air formed through the wall of said shank downstream from said coupler and upstream from said barrier.

5. In a cigarette holder of the kind in which tars and nicotine components are to be precipitated out of the smoke and which holder includes a shank having a cigarette coupler at its smoke input end and a bit at its smoke outlet end and a flow path extending through the shank from the inlet at the coupler to the outlet at the bit, in combination:

means in said flow path for causing smoke traversing the flow path to be accelerated, change direction, and expand, in that order, at first, second and third successive positions, respectively, along said flow path;

means for introducing a quantity of ambient air into said flow path at said third position at which said smoke is made to expand;

means for causing smoke to be accelerated comprising a barrier extending across said flow path downstream from said coupler and formed with a perforation to complete said path;

said shank being formed with a substantially cylindrical chamber immediately downstream from said barrier with its axis substantially coincident with that of the shank;

said means for causing smoke to change direction comprising a filter plug disposed in said chamber with its axis substantially coincident with the axis of said chamber and with its upstream end in close proximity to said perforation in said barrier, the diameter of the forward end of said plug being greater than the diameter across said perforation and less than the diameter of the shank at said chamber;

said means for causing smoke traversing the flow path to be expanded comprising an enlargement of said chamber formed by a reduction in the diameter of said plug at a region downstream from its upstream end;

said plug having reduced diameter over a mid-region of its length whereby the chamber has a cross-sectional area which is greater at the mid-region of the length of said plug than it has cross-sectional area upstream and downstream from said mid-region; and a second inlet for ambient air formed through the wall of said shank downstream from said coupler and upstream from said barrier.

* * * * *